US009943199B2

(12) United States Patent
Grey et al.

(10) Patent No.: US 9,943,199 B2
(45) Date of Patent: Apr. 17, 2018

(54) HAND-HELD VACUUM CLEANER

(71) Applicant: GREY TECHNOLOGY LIMITED, Spetchley, Worcestershire (GB)

(72) Inventors: Nicholas Gerald Grey, Spetchley (GB); Christopher Vagges, Spetchley (GB)

( * ) Notice: Subject to any disclaimer, the term of this patent is extended or adjusted under 35 U.S.C. 154(b) by 0 days.

(21) Appl. No.: 14/895,859

(22) PCT Filed: Jun. 5, 2014

(86) PCT No.: PCT/GB2014/051737
§ 371 (c)(1),
(2) Date: Dec. 3, 2015

(87) PCT Pub. No.: WO2014/195711
PCT Pub. Date: Dec. 11, 2014

(65) Prior Publication Data

US 2016/0128527 A1 May 12, 2016

(30) Foreign Application Priority Data

Jun. 5, 2013 (GB) ..... 1310052.4
Oct. 28, 2013 (GB) ..... 1318925.3

(51) Int. Cl.
*A47L 5/24* (2006.01)
*A47L 9/24* (2006.01)
(Continued)

(52) U.S. Cl.
CPC ..... *A47L 5/24* (2013.01); *A47L 9/0606* (2013.01); *A47L 9/19* (2013.01); *A47L 9/24* (2013.01); *A47L 9/244* (2013.01); *A47L 9/2831* (2013.01)

(58) Field of Classification Search
CPC ... A47L 5/24; A47L 9/28; A47L 9/244; A47L 9/2831
(Continued)

(56) References Cited

U.S. PATENT DOCUMENTS 1,829,582 A 10/1931 Carson
2,375,331 A 5/1945 Taylor
(Continued)

FOREIGN PATENT DOCUMENTS

CN 202699031 1/2013
DE 3016965 A1 11/1981
(Continued)

OTHER PUBLICATIONS

PCT Written Opinion of the International Searching Authority, PCT/GB2014/051737, dated Aug. 22, 2014, Applicant: Grey Technology Limited.
(Continued)

*Primary Examiner* — Michael Jennings
(74) *Attorney, Agent, or Firm* — Pedersen and Company, PLLC; Ken J. Pedersen; Barbara S. Pedersen

(57) ABSTRACT

This invention relates to a hand-held vacuum cleaner (10). The vacuum cleaner is expected to have particular utility for cleaning locations which are difficult to reach with a conventional vacuum cleaner. The vacuum cleaner (10) has a body (12) with a substantially planar base (22) upon which the vacuum cleaner can rest when not in use, the body having a carrying handle (20), a motor (14) and an impeller (16) located within the body, the vacuum cleaner also having a collector (26, 126) and a battery pack (18), the battery pack providing at least a part of the base (22). The motor and the battery pack are located between the base and the collector so as to lower the center of gravity and make the vacuum cleaner more comfortable for use, especially over long
(Continued)

periods. Ideally, the center of gravity is close to the carrying handle, and between the carrying handle and the nozzle so that the vacuum cleaner is slightly "nose heavy".

19 Claims, 10 Drawing Sheets

(51) Int. Cl.
*A47L 9/06* (2006.01)
*A47L 9/19* (2006.01)
*A47L 9/28* (2006.01)

(58) Field of Classification Search
USPC ..... 15/327, 344, 323, 350
See application file for complete search history.

(56) References Cited

U.S. PATENT DOCUMENTS

| | | | | |
|---|---|---|---|---|
| 2,867,833 | A | 1/1959 | Duff | |
| 4,513,470 | A * | 4/1985 | Toya | A47L 5/24 15/328 |
| 4,573,234 | A * | 3/1986 | Kochte | A47L 5/24 15/323 |
| 4,682,384 | A * | 7/1987 | Prahl | A47L 5/24 15/344 |
| 4,905,342 | A * | 3/1990 | Ataka | A47L 9/244 15/327.7 |
| 4,924,548 | A | 5/1990 | Touya et al. | |
| 5,500,978 | A * | 3/1996 | Levine | A47L 9/14 15/344 |
| 5,561,885 | A * | 10/1996 | Zahuranec | A47L 5/24 15/323 |
| 5,586,358 | A * | 12/1996 | Wolfe | A47L 5/26 15/334 |
| 5,590,439 | A | 1/1997 | Alazet | |
| 5,599,401 | A * | 2/1997 | Brosky | A47L 5/24 134/21 |
| 6,009,594 | A | 1/2000 | Grey | |
| 6,055,701 | A | 5/2000 | Grey et al. | |
| 6,101,668 | A | 8/2000 | Grey | |
| 6,243,912 | B1 | 6/2001 | Grey | |
| 6,949,130 | B1 | 9/2005 | Grey et al. | |
| 6,968,587 | B2 | 11/2005 | Grey | |
| 7,013,521 | B2 | 3/2006 | Grey | |
| 7,017,221 | B1 | 3/2006 | Grey et al. | |
| D554,814 | S | 11/2007 | Grey | |
| 7,331,078 | B2 | 2/2008 | Grey | |
| 7,334,284 | B2 | 2/2008 | Grey | |
| D568,008 | S | 4/2008 | Grey | |
| 7,802,343 | B2 | 9/2010 | Grey | |
| 8,069,529 | B2 * | 12/2011 | Groff | A47L 5/24 15/344 |
| D694,481 | S | 11/2013 | Grey et al. | |
| 2002/0148070 | A1 | 10/2002 | Tsuchiya et al. | |
| 2002/0189048 | A1 * | 12/2002 | Maruyama | A47L 5/24 15/344 |
| 2004/0074027 | A1 | 4/2004 | Grey | |
| 2005/0138764 | A1 | 6/2005 | Grey | |
| 2006/0000040 | A1 | 1/2006 | Grey et al. | |
| 2007/0022563 | A1 | 2/2007 | Wu | |
| 2008/0022485 | A1 | 1/2008 | Grey | |
| 2008/0235897 | A1 | 10/2008 | Kim et al. | |
| 2009/0300873 | A1 | 12/2009 | Grey | |
| 2013/0291333 | A1 | 11/2013 | Grey | |
| 2014/0304938 | A1 | 10/2014 | Grey | |

FOREIGN PATENT DOCUMENTS

| | | | |
|---|---|---|---|
| DE | 102004041021 | B3 | 8/2005 |
| DE | 202011051194 | U1 | 2/2013 |
| EP | 0232761 | A2 | 8/1987 |
| EP | 0847721 | A2 | 6/1998 |
| EP | 2215947 | A2 | 8/2010 |
| GB | 1276402 | A | 6/1972 |
| GB | 2269475 | A | 2/1994 |
| JP | S55124237 | U1 | 9/1980 |
| JP | S5644642 | U1 | 4/1981 |
| JP | H03237949 | A | 10/1991 |
| JP | 2004337427 | A | 12/2004 |
| JP | 2006312066 | A | 11/2006 |
| WO | 0150935 | A1 | 7/2001 |
| WO | 2006/131706 | A1 | 12/2006 |

OTHER PUBLICATIONS

PCT International Search Report, PCT/GB2014/051737, dated Aug. 22, 2014, Applicant: Grey Technology Limited.
GB Examination Report, Application No. GB1420520.7, dated Jan. 27, 2015, Applicant: Grey Technology Limited, Intellectual Property Office, UK.
GB Examination Report, Application No. GB1420520.7, dated Jun. 3 2015, Applicant: Grey Technology Limited, Intellectual Property Office, UK.
List of Examiner citations, Search Report, in corresponding Application No. GB1406139.4, Grey Technology, dated Oct. 6, 2014.
PCT International Search Report for PCT/GB2011/052542, dated Mar. 29, 2012, Applicant: Grey Technology Limited.
GB Search Report for GB1021655.4, Dated Apr. 21, 2011, Applicant: Grey Technology Limited, Intellectual Property Office, UK.
Translation of German Patent DE 10 2004 041 021 B3.

* cited by examiner

HAND-HELD VACUUM CLEANER

FIELD OF THE INVENTION

This invention relates to a hand-held vacuum cleaner and to an extendable hose.

The vacuum cleaner is expected to have particular utility for cleaning locations which are difficult to reach with a conventional vacuum cleaner suction head, such as would normally be cleaned with the vacuum cleaner tools, including stairs, upholstery, the upper or ceiling corners of rooms where cobwebs and debris can accumulate, and also light fittings, for example. The extendable hose may be used with the hand-held vacuum cleaner, but is not limited to such use as explained below.

In the following description, directional and orientational terms such as "below", "bottom" etc. are to be understood in relation to the hand-held vacuum cleaner in its normal orientation of use as defined below (and as shown in FIGS. 1-7).

BACKGROUND TO THE INVENTION

The owners or occupiers of many domestic and commercial premises utilise a vacuum cleaner to clean the floors and other areas of the premises. A vacuum cleaner operates by generating an air flow through a suction head which is placed upon or against the area to be cleaned. Dirt and debris become entrained in the air flow and are thereby carried into a collector for subsequent disposal. A vacuum cleaner may be used for a full-house clean or in between full-house cleans for spillages or spot cleaning.

Most domestic vacuum cleaners fall into two broad classes. The first class is often referred to as cylinder vacuum cleaners. In cylinder vacuum cleaners the suction head is connected via a rigid extension tube to an operating handle which in turn is connected to a flexible hose through which the dirt and debris pass on their way to the collector. The collector is located within a body which also contains the motor, the body having wheels or slides by which it may be pulled across the floor during the cleaning operation.

The second class is often referred to as upright vacuum cleaners. In upright vacuum cleaners the motor and collector are carried by, or in some cases are integral with, the operating handle, so that the body containing the motor and the collector typically lie above the suction head during the cleaning operation.

The suction head of both classes of vacuum cleaner can be fitted with a rotating brush which is designed to engage and physically move dirt and debris into the suction head where it can be entrained in the air flow. Also, both classes of vacuum cleaner can incorporate a steering joint between the suction head and the operating handle, allowing the suction head to be steered in a chosen direction.

Although the suction head of a cylinder vacuum cleaner is connected to the body by way of a flexible hose and can be manoeuvred so as to allow the cleaning of walls, stairs and the like, it is uncommon to do so. Instead, the suction head and extension tubes are typically removed from the hose and replaced by a smaller upholstery tool, dusting brush, crevice tool or other cleaning tool whereby to undertake a particular cleaning operation. Such tools may be used together with an extension tube to clean locations which are high up by more diligent users.

It is not possible to manoeuvre the suction head of an upright vacuum cleaner in the same way as that of a cylinder vacuum cleaner, and in order to enable the cleaning of areas such as stairs the manufacturers of upright vacuum cleaners provide an alternative solution. Specifically, the upright vacuum cleaner is typically fitted with a length of extendable flexible hose between the suction head and the collector, the end of the hose adjacent to the suction head being releasable whereby the end of the released hose can be fitted with a cleaning tool and manoeuvred to the desired location without the user having to move the remainder of the vacuum cleaner. The flexible hose is typically made extendable so that during normal use of the vacuum cleaner the contracted hose can be stored easily and conveniently upon the body of the vacuum cleaner. When released from its stored position the hose can be extended to reach the desired location.

Once again, however, the hose is difficult to manoeuvre to the location of use, and the resilience of the hose increases the force which must be provided in order to reach less accessible locations. The force required often exceeds that required to tip over the vacuum cleaner, and it is known for an upright vacuum cleaner to fall over during periods of use of the extended hose.

In any event, the suction head of a cylinder vacuum cleaner, and the released end of the extendable flexible hose of an upright vacuum cleaner, are manoeuvrable only within the limit set by the length of the hose. It may not be possible to reach more remote locations (such as the ceiling above a flight of stairs for example) without also lifting the body of the vacuum cleaner off the floor.

Most homes have at least one mains-powered vacuum cleaner of the first or second class described above.

A third type of vacuum cleaner is a hand-held vacuum cleaner. Hand-held vacuum cleaners are typically battery-operated and are distinguished by having a carrying handle which permits the whole vacuum cleaner to be carried during use (typically by one hand), the user being able to manoeuvre the nozzle of the vacuum cleaner to the location of use. Hand-held vacuum cleaners are intended to supplement mains-powered vacuum cleaners. Conventional hand-held vacuum cleaners are suitable for use in cleaning small areas, or for removing localised debris such as might occur during the spillage of a granular product. Notwithstanding the fact that the present vacuum cleaner is also hand-held, it has little in common with the known hand-held vacuum cleaners. Specifically, the present vacuum cleaner is intended to replace the tools of a mains-powered vacuum cleaner in terms of a normal full house clean without needing to be recharged. The area which can be cleaned during a single cleaning operation with the present vacuum cleaner is therefore large, and in particular is significantly larger than the area which can be cleaned with a known hand-held vacuum cleaner before it is necessary to recharge the vacuum cleaner.

In particular, the surface area of the furniture, walls and ceiling of a typical room may be around five times the surface area of the floor. Whilst the majority of any dirt and debris present within a room will likely fall to the floor, the "above-floor" area presents a significant area to be cleaned. An upright vacuum cleaner is totally unsuited to above-floor cleaning and a cylinder vacuum cleaner is not ideally suited for such an operation. Also, the known hand-held cleaners are not well suited to cleaning the large surface areas involved. There is therefore presently no vacuum cleaner which is designed for, and which is therefore well-suited to, above-floor cleaning, for example the routine cleaning of large areas such as walls and ceilings.

The extendable flexible hoses which are conventionally used with upright vacuum cleaners have a coil spring (usually of metal) typically located between two layers of plastic. The layers of plastic are bonded together (typically by partial melting so as to form a single layer) and thereby become bound to the coil spring. The coil spring provides the resilience for the hose to return to its contracted length, and the plastic layer makes the hose airtight.

It is a feature of the extendable flexible hoses comprising a coil spring that the spring seeks to unwind as it is stretched, and similarly seeks to re-wind as it contracts. The user will typically grip the free end of the hose before it is extended, and will often be forced to reposition the grip so that the spring can unwind as the hose is extended. The force with which the coil spring seeks to unwind can be significant, and if the user attempts to resist the unwinding then parts of the hose can collapse, with the result that less air can flow therealong.

Allowing the coil spring to unwind as it is stretched it is not always desirable. If, for example, the hose is connected to a directional cleaning tool such as a crevice tool, the user will often have fitted the cleaning tool to the released end of the hose in its desired orientation with the spring contracted. When the hose is extended and the coil spring unwinds, the user will likely have to re-orient the cleaning tool.

The manufacturers of some upright vacuum cleaners have recognised this problem, and seek to overcome it by providing a rotatable joint at the free end of the hose. The cleaning tool can therefore rotate relative to the extendable hose, and can maintain the desired orientation despite the unwinding of the coil spring.

The addition of a rotatable joint represents additional manufacturing cost. Also, a rotatable joint is relatively bulky compared to the remainder of the extendable hose and the joint can become stiff over time. It is usually not desirable to increase significantly the exterior dimension of the hose, and so it is usual to provide a rotatable joint which is only slightly larger (if at all) than the cross-section of the hose. This necessarily results in the rotatable joint restricting the air flow path, and increasing the likelihood of the hose becoming blocked adjacent to the rotatable joint.

The reduction of air flow along the extendable flexible hose is particularly significant in most upright vacuum cleaners, as the rotatable joint restricts the air flow whether the hose is released or not. The reduced air flow is therefore suffered during the major proportion of the vacuum cleaner's usage during which the hose is connected to the suction head and the rotatable joint is redundant.

SUMMARY OF THE INVENTION

The present invention does not seek to replicate those features of a conventional vacuum cleaner which make it suitable for cleaning floors for example (though it can be used for such purposes if desired). Instead, the present vacuum cleaner is intended for above-floor cleaning and for cleaning more remote and less accessible areas for which a conventional vacuum cleaner is not well suited.

According to a first aspect of the invention, there is provided a hand-held vacuum cleaner having a body with a substantially planar base upon which the vacuum cleaner can rest when not in use, the body having a carrying handle, a motor and an impeller located within the body, the vacuum cleaner also having a collector and a battery, the battery having a housing which provides at least a part of the base, the motor and the impeller being located between the base and the collector.

For the avoidance of doubt, the term "impeller" as used in this specification embraces all devices for creating air flow within the vacuum. The term therefore also includes fans and turbines for example.

It will be recognised that the motor and the battery (or more usually the battery pack) are typically the heaviest individual components of the vacuum cleaner, and that locating these components between the base and the collector acts to lower the centre of gravity towards the base. The present inventor has therefore appreciated that lowering the centre of gravity will increase the comfort of use of the vacuum cleaner, and thereby allow it to be used for extended periods of time without undue fatigue of the user.

Alternatively stated, the present inventor has sought to design a hand-held vacuum cleaner which can be used for extended periods as may be required to clean large areas. The inventor has appreciated that moving the centre of gravity towards the base (and also moving the centre of gravity towards the carrying handle), will reduce the offset weight which the user must withstand, the offset weight leading to fatigue and discomfort for the user over time.

The inventor has also appreciated that it is not necessary to have the centre of gravity of the vacuum cleaner coincident with the carrying handle (although that might be the optimum in terms of the avoidance of fatigue), but rather it is preferable to have the centre of gravity offset from the carrying handle in the direction of the nozzle, so that the vacuum cleaner is slightly "nose-heavy" during use.

The inventor has identified that the known hand-held vacuum cleaners have a centre of gravity which is some distance from the carrying handle, and also some distance from the base. Most users do not always suffer fatigue or discomfort, however, because the known hand-held vacuum cleaners are typically not used for periods of time which are long enough for fatigue or discomfort to become troublesome.

Ideally, the carrying handle is connected to the remainder of the vacuum cleaner at its top end and at its bottom end. The carrying handle thereby forms a closed loop with the body of the vacuum cleaner. The provision of such a carrying handle results in a more robust and rigid structure than would be provided by a carrying handle mounted at only one of its ends.

Preferably, the carrying handle has a longitudinal axis which is at an acute angle to the base. The angle is preferably between 50° and 70° and is ideally around 60°. The inventor has discovered that angling the carrying handle at around 60° to the base makes the vacuum cleaner comfortable to lift and manoeuvre.

According to a second aspect of the invention, there is provided a hand-held vacuum cleaner having a carrying handle, a motor, a battery, an impeller, a collector, and a nozzle in communication with the collector, in which at least part of the carrying handle is hollow and adapted to locate a crevice tool. A crevice tool is a substantially linear tube which is tapered so as to be suitable for fitting into smaller gaps than the nozzle. A crevice tool is commonly provided with a cylinder or upright vacuum cleaner and is designed to fit to the end of the flexible hose. Some upright and cylinder vacuum cleaners will have storage means for the crevice tool, and also for other removable tools such as a dusting brush and an upholstery tool which are typically provided. Storing the tools on the vacuum cleaner is particularly user-friendly as the tools are easily accessible when a particular tool is required.

Hand-held vacuum cleaner tools are generally small and compromised so that they can be attached to the body in some way. Full size tools are uncommon, however, and if any such tools are provided they will typically be stored separately from the hand-held vacuum cleaner and must be retrieved before they can be used. Providing a hollow carrying handle enables the storage of a crevice tool upon the vacuum cleaner. Also, the crevice tool can be as large as the crevice tool of many upright and cylinder vacuum cleaners; it is not necessary to provide a reduced-size tool which can more easily be stored upon the vacuum cleaner as is the case with some known hand-held vacuum cleaners.

Upholstery tools are also known for hand-held vacuum cleaners. However, they are generally poorly designed, being too narrow to clean large areas and combined inconveniently with other tools such as dust brushes.

Preferably, the nozzle mounts a retractable dust brush. The dust brush can be extended when required, the bristles of the dust brush extending beyond the remainder of the nozzle. When not required, however, the dust brush can be retracted so that the bristles do not extend beyond the remainder of the nozzle. It may, for example, be desirable to retract the dust brush when the crevice tool or the upholstery tool is fitted to the nozzle.

According to a third aspect of the invention, there is provided a hand-held vacuum cleaner having a carrying handle, a motor, a battery, an impeller, a collector, and a nozzle in communication with the collector, in which the nozzle is connected to an extendable flexible hose. Preferably, the flexible hose is located within a substantially rigid tube. During normal use of the vacuum cleaner the (non-extended) hose is retained within the substantially rigid tube whereby the vacuum cleaner can be manoeuvred so that the nozzle is directed to the desired locations. The nozzle (and any tool carried thereby) can if desired be pressed against the surface to be cleaned without any likelihood of unwanted movement caused by inadvertent flexing of the hose.

It is intended that the vacuum cleaner is sufficiently lightweight that most users can lift the vacuum cleaner above their head so as to position the nozzle adjacent to the ceiling corners of a room, for example. If, however, it is desired to clean more inaccessible locations, or if the user wishes to avoid lifting the vacuum cleaner above head height, the nozzle can be removed from the remainder of the vacuum cleaner and the flexible hose extended in order to permit the nozzle alone to be manoeuvred to the desired position.

According to a fourth aspect of the invention, there is provided a hand-held vacuum cleaner having a carrying handle, a motor, a battery, an impeller, a collector, a nozzle in communication with the collector, and a lighting unit adapted to illuminate the region adjacent to the nozzle. It is often the case that the more remote and less accessible locations for which the present vacuum cleaner is likely to be used will be less well illuminated by natural daylight or by room lighting. Providing a lighting unit on the vacuum cleaner which can illuminate the area being cleaned is particularly advantageous.

Preferably, the vacuum cleaner according to the fourth aspect has a control switch to actuate the motor, the control switch also actuating the lighting unit. Desirably, the control switch is a two-position switch, with a first position actuating the lighting unit and a second position actuating the motor. In this way, a single control switch can be used to operate both the lighting unit and the motor. Ideally, the control switch comprises a push-button, the first position being a partially depressed position and the second position being a fully depressed (or at least a further depressed) position.

Preferably, movement of the control switch causes movement of an actuating beam, the actuating beam engaging a first switch which controls the lighting unit and a second switch which controls the motor. It is arranged that the force to actuate the first switch is similar to the force to actuate the second switch, and it is also arranged that the control switch is located closer to the first switch than to the second switch. Because the actuator beam is interposed between the control switch and the first and second switches, such an arrangement allows the control switch to actuate the first switch before it actuates the second switch. This ensures that the lighting unit provides illumination adjacent to the nozzle before the motor is actuated, allowing the user to position the nozzle accurately without the motor running.

Preferably, the vacuum cleaner according to any of the stated aspects has a cyclonic separator. The advantage of cyclonic separation (which is used in certain upright and cylinder vacuum cleaners) in avoiding the requirement for a separate bag into which the dirt and debris are collected can therefore be shared by the present vacuum cleaner.

Cyclonic vacuum cleaners typically have additional mechanical filters because the cyclones do not capture all of the dirt. Some of the known cyclonic vacuum cleaners have multiple-stage cyclones, each stage being adapted to capture different types of dirt and debris. Typically the first stage will capture hair and fluff, and the second (or subsequent) stage will capture fine dust. It is recognised that such multi-stage cyclones are most effective when used at a known orientation. However, when used in some orientations a significantly higher percentage of dust passes through to the cyclones to the filter. Multi-stage cyclones are therefore not suitable for hand-held vacuum cleaners in which the orientation of the cyclone cannot be controlled. Alternatively stated, notwithstanding that a multi-stage cyclonic separator will typically pass less fine dust to its filters than a single stage cyclonic separator, a single-stage cyclonic separator is more suitable for use in a hand-held vacuum cleaner since it is better able to tolerate different orientations without a significant loss of cleaning effectiveness.

Also, multi-stage cyclones are more bulky than single cyclones so there is generally less room for a mechanical filter. Furthermore, multi-stage cyclones typically absorb more energy than single cyclones, which is a particular concern for battery powered vacuum cleaners such as hand-held vacuum cleaners.

The term cyclonic is generally used to describe a vacuum cleaner in which the dirt is separated from the air flow as the air flow spins within a collection chamber.

Conventional cyclonic separators have collection chambers in which the air flow is directed to spin many times around the chamber before leaving the chamber.

The inventors have realised that the rapidly spinning air within the initial stage of a conventional cyclonic separator results in a high proportion of the finer dirt and dust being separated from the larger and fibrous material and being entrained within the air flow leaving the initial stage. The (initial) cyclonic separation is therefore suited to removing mainly larger particles of dirt, including hair and fluff for example. The prior art vacuum cleaners using cyclonic separation remove the fine dirt and dust by using multiple, successive, cyclonic stages.

As above indicated, the use of multiple stages is not ideal for hand-held vacuum cleaners. The inventors therefore seek to avoid the requirement for a multi-stage cyclone by seeking to capture the fine dirt and dust together with the larger particles of dirt, i.e. seeking to ensure that the fine dirt and dust is separated from the air flow as quickly as possible.

According to a fifth aspect of the invention, there is provided a hand-held vacuum cleaner having a carrying handle, a motor, a battery, an impeller, a collector, a nozzle in communication with the collector, and a baffle located within the collector so as to direct the air flow towards the bottom of the collector. The dirt and debris within the air flow becomes static at the bottom of the collector and builds up. By building up a static pile of debris of which the majority by volume is fibrous, a significant amount of the fine dust remains in the collector. The baffle reduces the likelihood that the air will flow around the collector many times, and helps to ensure that more of the entrained fine dirt and dust is separated from the air flow and held within the built-up fibrous debris.

Alternatively stated, according to this aspect of the invention there is provided a hand-held vacuum cleaner having a carrying handle, a motor, a battery, an impeller, a collector, and a nozzle in communication with the collector, the collector having a top end and a bottom end and comprising a centrifugal separator in which the incoming air is arranged to flow substantially circumferentially around the top end of the collector, the collector having a baffle adapted to redirect the circumferential air flow towards the bottom end.

Preferably, the baffle also has a first surface which acts to direct the incoming air to flow circumferentially around the top end of the collector.

It has also been found that capturing the fine dirt and dust together with the larger particles of dirt, and in particular with fluff and hair, has an additional benefit. Specifically, when multi-stage cyclonic vacuum cleaners are emptied typically a substantial cloud of dust will become airborne. This is considered by some to be a health risk, and in any event defeats the apparatus as the cloud of dust may be redistributed around the home. When the fine dirt and dust is collected within a body of fluff and hair significantly less becomes airborne when the collector is emptied.

The present vacuum cleaner therefore preferably operates "centrifugally" in that the dirt becomes separated from a rotating air flow. It is believed that the term centrifugally is more accurate than the term "cyclonic" in view of the limited number of times which the air flows around the collector in the present invention (and in practice the air flow may pass less than one rotation around the collector).

According to a sixth aspect of the present invention there is provided a hand-held vacuum cleaner having a carrying handle, a motor, a battery, an impeller, a filter and a centrifugal collector, the vacuum cleaner also having a nozzle in communication with the collector, the vacuum cleaner having a base upon which the vacuum cleaner can rest when not in use, the base being substantially horizontal with the carrying handle above the base in the normal orientation of use of the vacuum cleaner, the motor and the battery being located below the centre of the carrying handle in the normal orientation of use.

The invention according to this sixth aspect provides a hand-held vacuum cleaner which operates centrifugally, and has the previously-stated advantages of a lowered centre of gravity. By appropriate positioning of the motor and battery (or more usually the battery pack) the centre of gravity can also be close to the carrying handle, further reducing the likelihood of fatigue of the user.

Preferably, the motor and the battery are located below the bottom of the carrying handle. It will be understood from the following description that the motor and battery may each be located at a respective level which is below the level of the bottom of the carrying handle. Thus, it is not necessarily the case that both the motor and battery are located directly below the bottom of the carrying handle.

As an alternative the collector of the present invention could comprise a chamber containing a bag and optional secondary filter if desired.

According to an seventh aspect of the invention, there is provided an extendable hose comprising a coil spring covered with an airtight material, the hose having a first part and a second part, the first part of the hose having a first coil spring and the second part having a second coil spring, the winding direction of the first coil spring being opposite to the winding direction of the second coil spring.

According to an eighth aspect of the invention, there is provided a hand-held vacuum cleaner having a carrying handle, a motor, a battery, an impeller, a collector, and a nozzle in communication with the collector by way of an extendable flexible hose. The extendable hose preferably comprises a coil spring covered with an airtight material, the hose having a first part and a second part, the first part of the hose having a first coil spring and the second part having a second coil spring, the winding direction of the first coil spring being opposite to the winding direction of the second coil spring.

When viewed from one end of the extendable flexible hose, the first coil spring is wound in a clockwise direction and the second coil spring is wound in an anti-clockwise direction.

It will be understood that as the hose of the present invention is extended the first coil spring seeks to unwind in one direction (e.g. clockwise), whilst the second coil spring seeks to unwind in the opposing direction (e.g. anti-clockwise).

Preferably, the first coil spring and the second coil spring are of substantially the same length, and each occupies around half of the length of the hose. Ideally the first and second coil springs are of identical lengths, and identical materials, so that their unwinding movements exactly cancel each other out. It will be understood, however, that the invention can be advantageous even if the unwinding movements do not exactly cancel out and there is some (small) resulting rotation of the free end of the hose.

The first coil spring and the second coil spring may be directly connected together, i.e. an end of the first coil spring is directly connected to an end of the second coil spring. Alternatively, a collar is provided so as to indirectly interconnect the first coil spring and the second coil spring.

According to a ninth aspect of the invention, there is provided a hand-held vacuum cleaner having a carrying handle, a motor, a battery, an impeller, a collector, and a nozzle in communication with the collector, the collector being between the carrying handle and the nozzle, the vacuum cleaner having an inlet for the collector, the inlet being located at side of the collector facing the carrying handle. This has been found to be a particularly beneficial feature as dirt within the collector is less likely to fall out (though the inlet) as the vacuum cleaner is carried. Thus, it will be understood that when the vacuum cleaner is not in use, the user will typically carry the vacuum cleaner with the nozzle directed downwardly (so that the inlet faces upwardly). If the inlet to the collector was located on the nozzle side of the collector some of the dirt would likely fall from the collector out of the nozzle.

This is a recognised concern with some hand-held vacuum cleaners in which the inlet is located to the nozzle side of the collector, and the manufacturers of such hand-held vacuum cleaners typically utilise a movable flap or shutter within the inlet so as to reduce the likelihood of collected dirt escaping. However, the use of a movable flap reduces the efficiency of the vacuum cleaner since some of the energy of the air flow is required to hold the flap open. Also, the flap increases the turbulence within the air flow. Turbulence within the air flow, particularly as it enters the collector, is disadvantageous in bagless vacuum cleaners.

Preferably, the air flows over the top of the collector as it passes from the nozzle to the inlet. This allows the air flow path to include an extendable flexible hose, and an optional surrounding tubular housing, without substantially increasing the distance of the nozzle from the carrying handle. It will be understood that minimising the distance of the nozzle from the carrying handle enhances the accuracy with which the vacuum cleaner can be used and also facilitates cleaning of confined areas (such as a car interior for example). Alternatively stated, it will be appreciated that if the inlet to the collector was located on the nozzle side of the collector, the provision of an extendable flexible hose would increase the overall dimensions of the vacuum cleaner significantly, and would also increase significantly the distance between the carrying handle and the nozzle.

Preferably, the rotational axis of the motor and the impeller are parallel with the longitudinal axis of the collector (and the axes are ideally aligned). Preferably also, the carrying handle is substantially linear and has a longitudinal axis, the longitudinal axis of the carrying handle being substantially parallel with the rotational axis of the motor and the impeller. Desirably, the collector is removably mounted to the body.

According to a tenth aspect of the invention, there is provided a hand-held vacuum cleaner having a carrying handle, a motor, a battery, an impeller, a collector, a nozzle in communication with the collector and a further tube between the nozzle and the collector, the vacuum cleaner being configured so that the further tube is substantially a continuation of the carrying handle. Preferably, the longitudinal axis of the nozzle is substantially parallel with the base and the longitudinal axis of the carrying handle is at an acute angle to the base.

Desirably, the acute angle is between 50° and 70°, and is ideally approximately 60°.

The vacuum cleaner according to this tenth aspect can have differently coloured regions, with for example the nozzle, further tube and carrying handle sharing the same colour so as to emphasise the connection between these components. The nozzle, further tube and carrying handle could thereby replicate the appearance of the handle of a cylinder vacuum cleaner, and this is expected to increase the appeal of the vacuum cleaner and perhaps also to alert customers to the intended purpose of the vacuum cleaner in supplementing a cylinder (or upright) vacuum cleaner.

It will be understood that certain aspects and/or features of the invention described above may be combined with one or more other aspects and/or features with which they are compatible, and all such combinations are within the scope of the present invention.

BRIEF DESCRIPTION OF THE PREFERRED EMBODIMENTS

The invention will now be described in more detail, by way of example, with reference to the accompanying drawings, in which.

DETAILED DESCRIPTION

Figure 1:
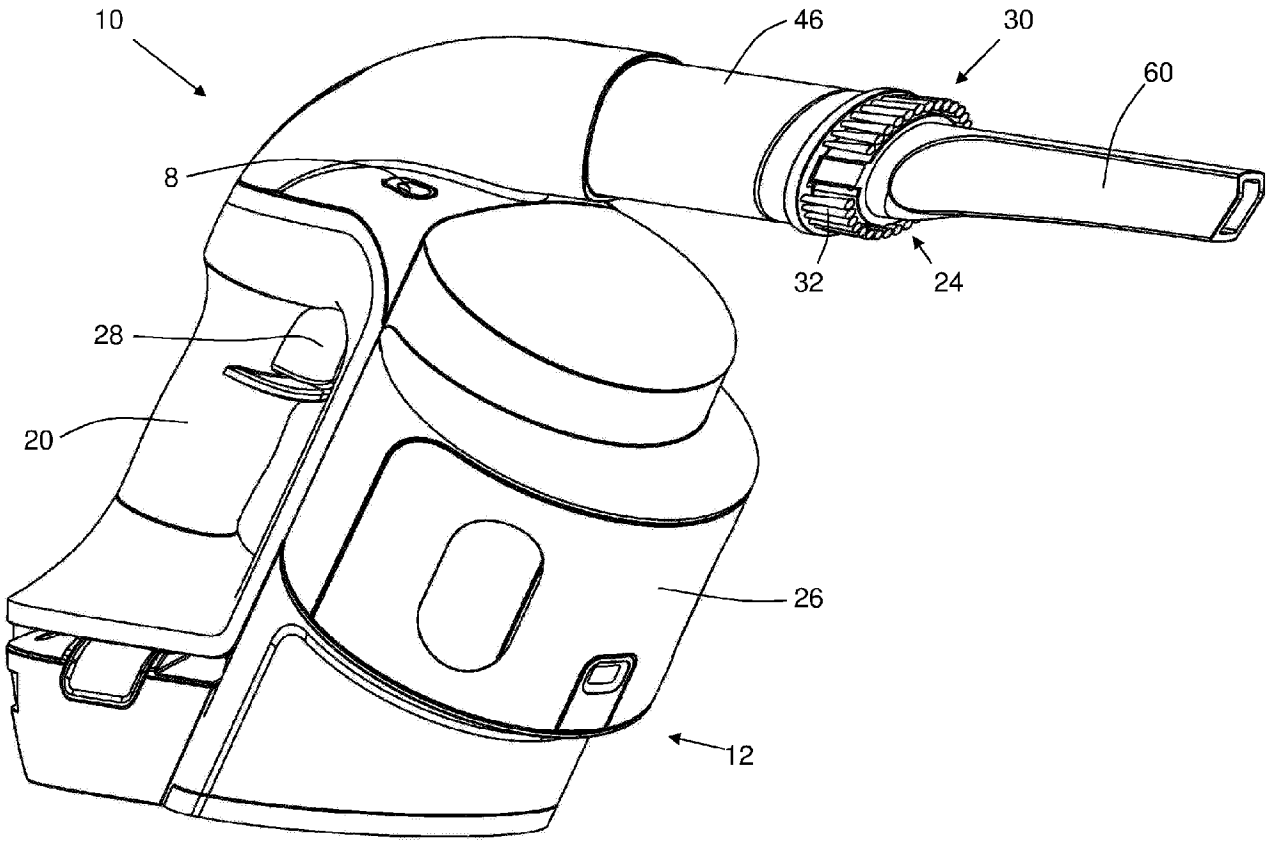
FIG. 1 shows a perspective view of the vacuum cleaner according to the invention, with a crevice tool fitted to the nozzle.

The vacuum cleaner 10 of FIG. 1 has a body 12. As seen in the sectional view of FIG. 2, the body 12 houses the motor 14 and impeller 16 which create the desired airflow. The body also houses the rechargeable battery which provides the electrical power to the motor 14. In common with many battery-powered devices, the battery comprises a battery pack 18 made up of a number of interconnected cells.

The body 12 has a carrying handle 20 by which the vacuum cleaner 10 can be lifted and manoeuvred (one-handed) by the user. The carrying handle is substantially linear with a longitudinal axis A-A which is at an angle $\alpha$ to the base 22. Ideally the angle $\alpha$ is around 60°, but angles of between 50° and 70° will also be comfortable to the user.

The base 22 is substantially flat and is designed to be the surface upon which the vacuum cleaner rests when not in use. The vacuum cleaner 10 is therefore stable when resting with its base 22 upon a substantially horizontal surface such as during storage upon a shelf or the floor for example.

Figure 3:
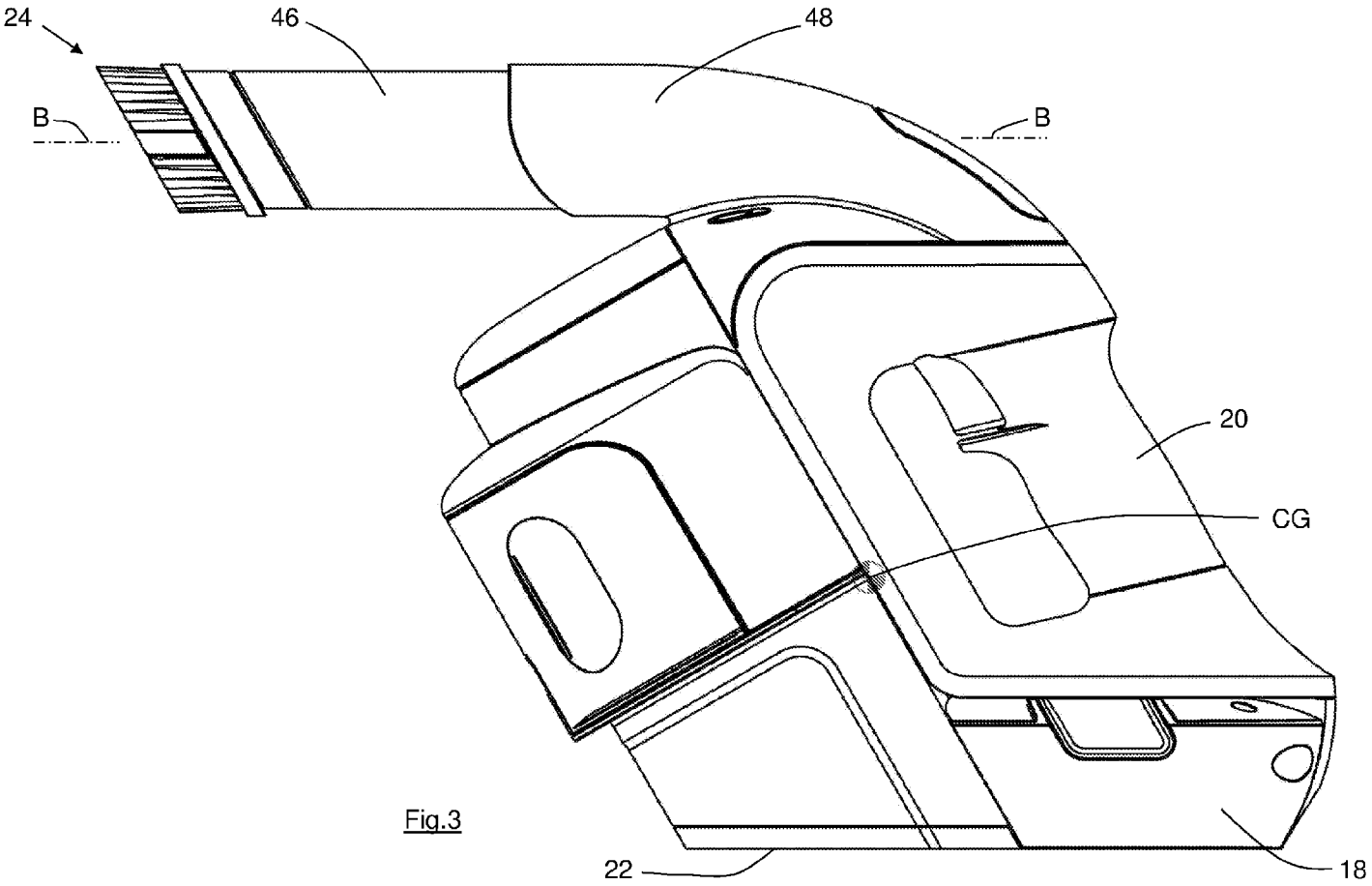
FIG. 3 shows a side view of the vacuum cleaner with the crevice tool in its storage location, and showing the centre of gravity of the vacuum cleaner.
Figure 5:
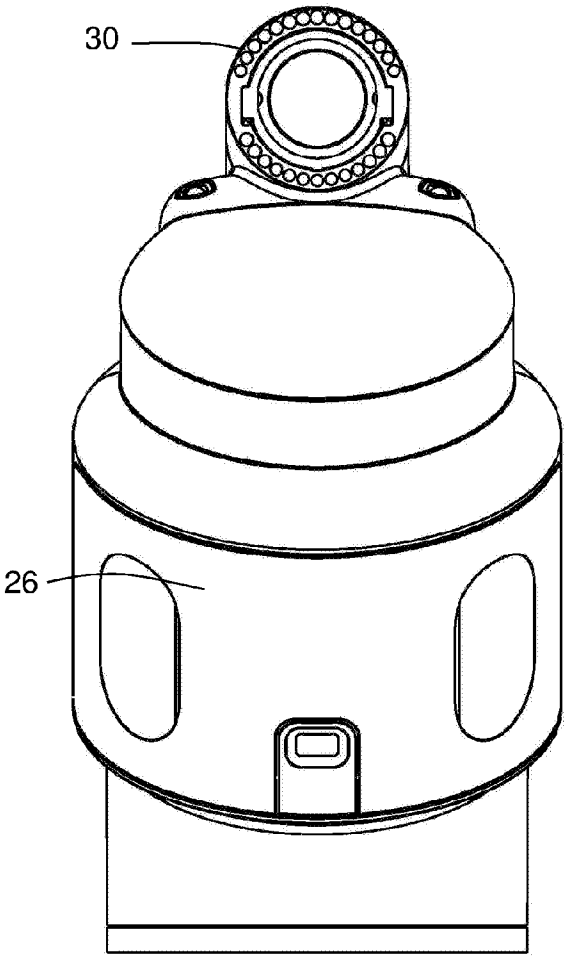
FIG. 5 shows a front view of the vacuum cleaner.
Figure 4:
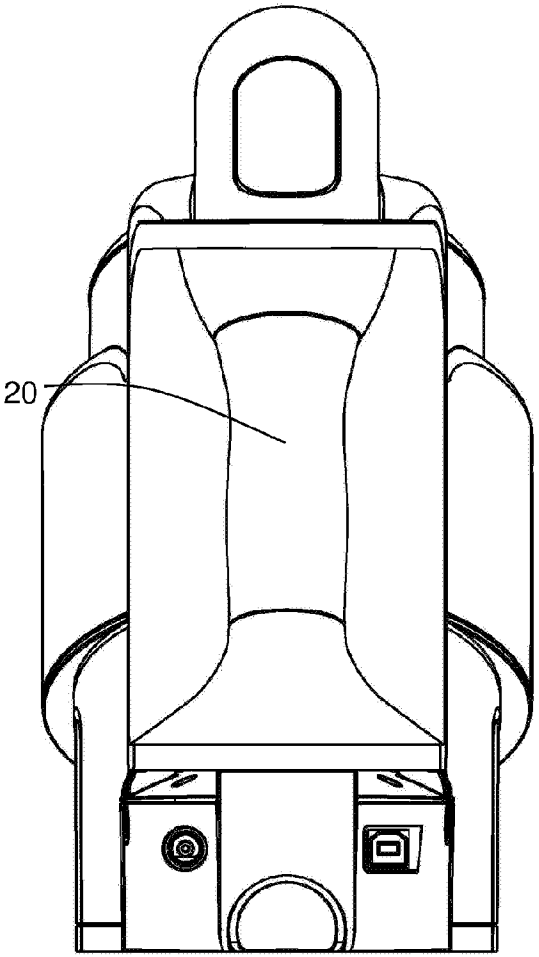
FIG. 4 shows a rear view of the vacuum cleaner.

The battery pack 18 in this embodiment is located within a removable housing, and can therefore be replaced if required. As seen in FIG. 3 in particular the housing of the battery pack 18 forms a part of the base 22. It will be understood that alternative embodiments have a non-removable battery pack, and that the battery pack 18 can be recharged without removal.

When in use the vacuum cleaner 10 can be lifted and carried by the user so that the nozzle 24 is positioned and directed as desired. It will be understood that the vacuum cleaner 10 may be oriented as desired by the user, with the base 22 adopting an angle other than horizontal during use. Nevertheless, for the avoidance of doubt the term "normal orientation of use" is used to describe the vacuum cleaner in an orientation with the base substantially horizontal and with the handle 20 above the base as shown in FIGS. 1-7.

Importantly, the motor 14, and the battery pack 18, are both located between the base 22 and a collector 26 in which the dirt and debris accumulates. In this embodiment the motor and battery pack are also located below the level of the centre C-C of the handle (the centre C-C being a plane substantially parallel to the base 18 and passing through the approximate centre of the handle 20, and furthermore below the level of the bottom B-B of the handle 20.

Locating the (relatively heavy) motor 14 and the (relatively heavy) battery pack 18 between the base 22 and the collector 26, and furthermore locating the battery pack 18 so that it is at least partially directly below the handle 20, results in the centre of gravity CG being located as shown in FIG. 3. It will be understood that it would be difficult in practice to provide a vacuum cleaner in which the centre of gravity was located coincident with the handle, but that is not necessary, and the arrangement as shown which results in the centre of gravity being very close to the handle 20, and yet being offset towards the nozzle 24 so as to provide a slight "nose-heavy" arrangement, is beneficial in practice.

It will be understood that the centre of gravity will move slightly during use, as the collector 26 fills with dirt and debris, but the weight of a full collector is likely to be significantly less than the weight of either of the battery pack 18 and the motor 14, so that the movement of the centre of gravity will be relatively small.

The carrying handle 20 permits the vacuum cleaner 10 to be manoeuvred in use so that the nozzle 24 is positioned and directed as required. The operating switch 28 is located upon the carrying handle 20 and can be depressed with one finger.

The body 12 carries a lighting unit 8, in this embodiment a light emitting diode, which is directed substantially in the direction of the nozzle 24 so that in use it can illuminate the region around the nozzle.

Figure 2:
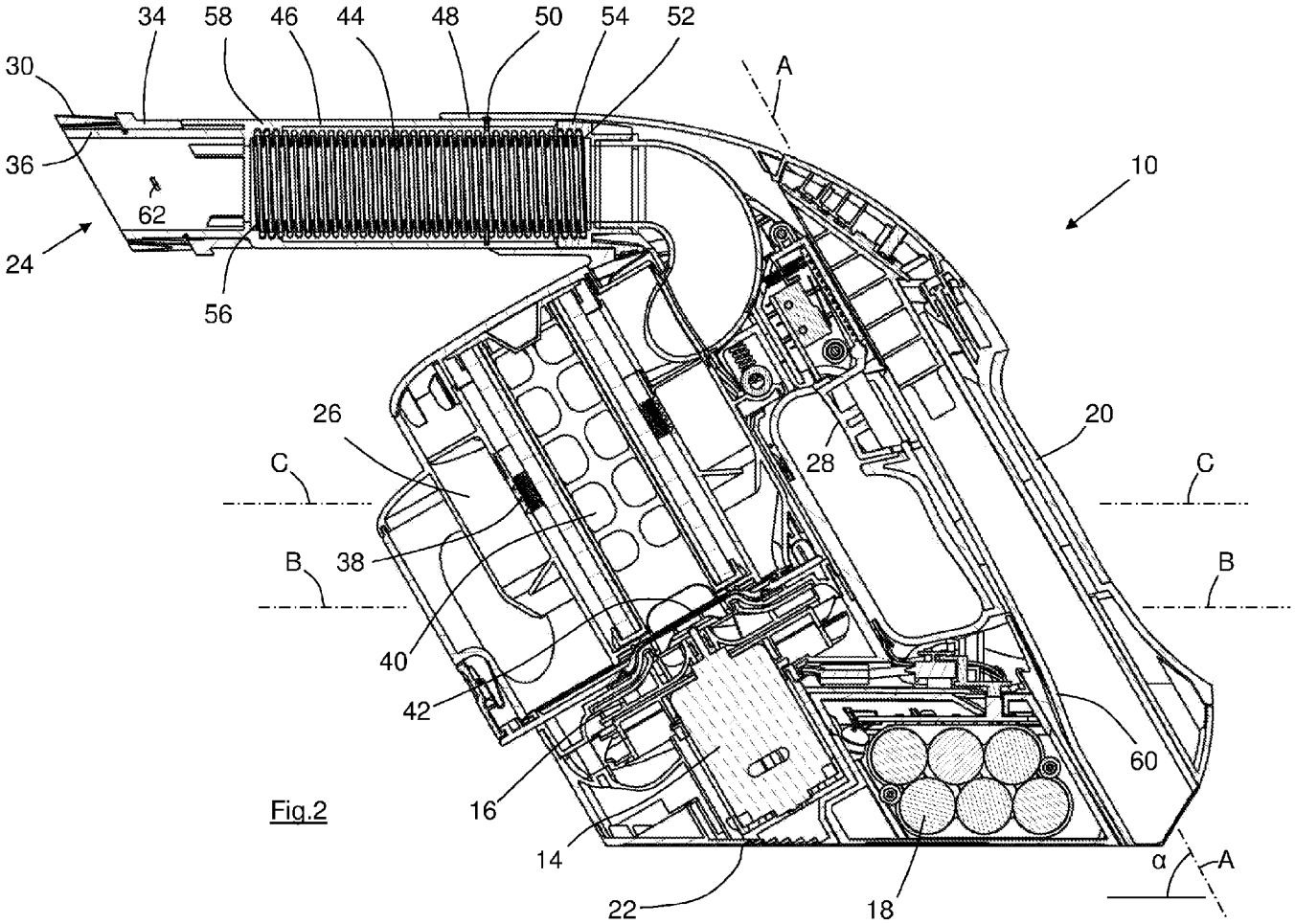
FIG. 2 shows a sectional view of the vacuum cleaner with the crevice tool in its storage location.

As shown in FIGS. 1 and 2, the nozzle 24 carries a retractable brush tool or dust brush 30. The brush tool 30 comprises several sets of bristles 32 which are mounted upon a sleeve 34, the sleeve 34 being movable relative to the tube 36 of the nozzle 20. In FIGS. 1 and 2 the brush tool 30 is retracted so that the bristles 32 do not extend beyond the end of the tube 36. When the brush tool 30 is required, however, the sleeve 34 can be slid from the position shown along the tube 36 so that the bristles 32 project beyond the end of the tube 36. The brush tool 30 can then be used to dislodge dust and the like into the air flow through the nozzle.

It is arranged that there is sufficient friction between the sleeve 34 and the tube 36 in order to avoid inadvertent retraction of the brush tool 30 (or a detent mechanism can be used if desired).

The brush tool 30 may be removably mounted to the nozzle 24, thereby making it possible to remove a damaged brush tool and replace it with a new component.

Air is drawn into the vacuum cleaner 10 through the nozzle 24 and into the collector 26. The collector 26 may be transparent so that the user is aware of the volume of dirt contained therein. The vacuum cleaner 10 operates according to a cyclonic (or centrifugal) principle, so that the collector 26 includes a cyclonic separator. The air flows rapidly around the collector 26 before passing through a perforated wall 38 and entering a central channel through one of the large perforations 40. The air then passes through a filter 42, passes the impeller 16, and leaves the vacuum cleaner body 12 through an exhaust outlet (not shown). If desired at least some of the air can be directed past the battery pack and/or the battery on its way to the exhaust, so as to cool the battery pack and/or motor.

Between the nozzle 24 and the collector 26 the air flows through a length of extendable flexible hose 44. In its contracted condition as shown in the figures most of the hose 44 is retained within a tubular housing 46. The tubular housing 46 is substantially rigid, and is releasably secured within a further tube 48 by a detent mechanism 50. The further tube 48 is securely connected to the body 12 of the vacuum cleaner 10.

In the embodiment shown the nozzle 24, the tubular housing 46 and the upstream end of the further tube 48 are all aligned and have a common longitudinal axis B-B (FIG. 3). Also, the longitudinal axis B-B is parallel with the base 22. Whilst these are desirable features they are not essential to the invention.

The first end 52 of the flexible hose 44 is sealingly secured to a connector 54 within the tube 48. The second end 56 of the flexible hose 44 is connected to an extension 58 of the nozzle 24.

When it is desired to release the hose 44 so that the nozzle 24 can be moved relative to the body 12 (perhaps into or adjacent to locations which cannot readily accommodate the body 12), the tubular housing 46 can be released from the tube 48. The hose 44 can then be extended so as to allow the nozzle 24 to be manoeuvred as required, the nozzle conveniently being manoeuvred by way of the tubular housing 46. After use, the hose is contracted and inserted back into the tubular housing 46 and the tubular housing 46 is clipped back into the tube 48.

It is arranged that the collector 26 is removable from the remainder of the body 12, i.e. when the collector 26 has become full, the user may grasp the collector 26 with one hand whilst the other hand is holding the carrying handle 20, the collector 26 being removable (together with the perforated tube 40 and the filter 42) whereby it may be emptied, and cleaned if required.

FIG. 1 shows a crevice tool 60 fitted to the nozzle 24. Specifically, the end of the crevice tool 24 is a tight fit within the tube 36 of the nozzle 24. FIG. 2 shows a raised rib 62 within the tube 36 which limits the insertion of the crevice tool 60. FIG. 2 shows the crevice tool 60 in its storage position within the hollow carrying handle 20, the bottom end of the carrying handle being open to receive the crevice tool 60. The crevice tool 60 in this embodiment is retained within the handle 20 by way of friction, and can be removed by the user inserting a finger into the bottom end of the crevice tool. In an alternative embodiment the bottom end of the crevice tool can project from the bottom end of the handle sufficiently to permit it to be gripped and removed for use.

Figure 6:
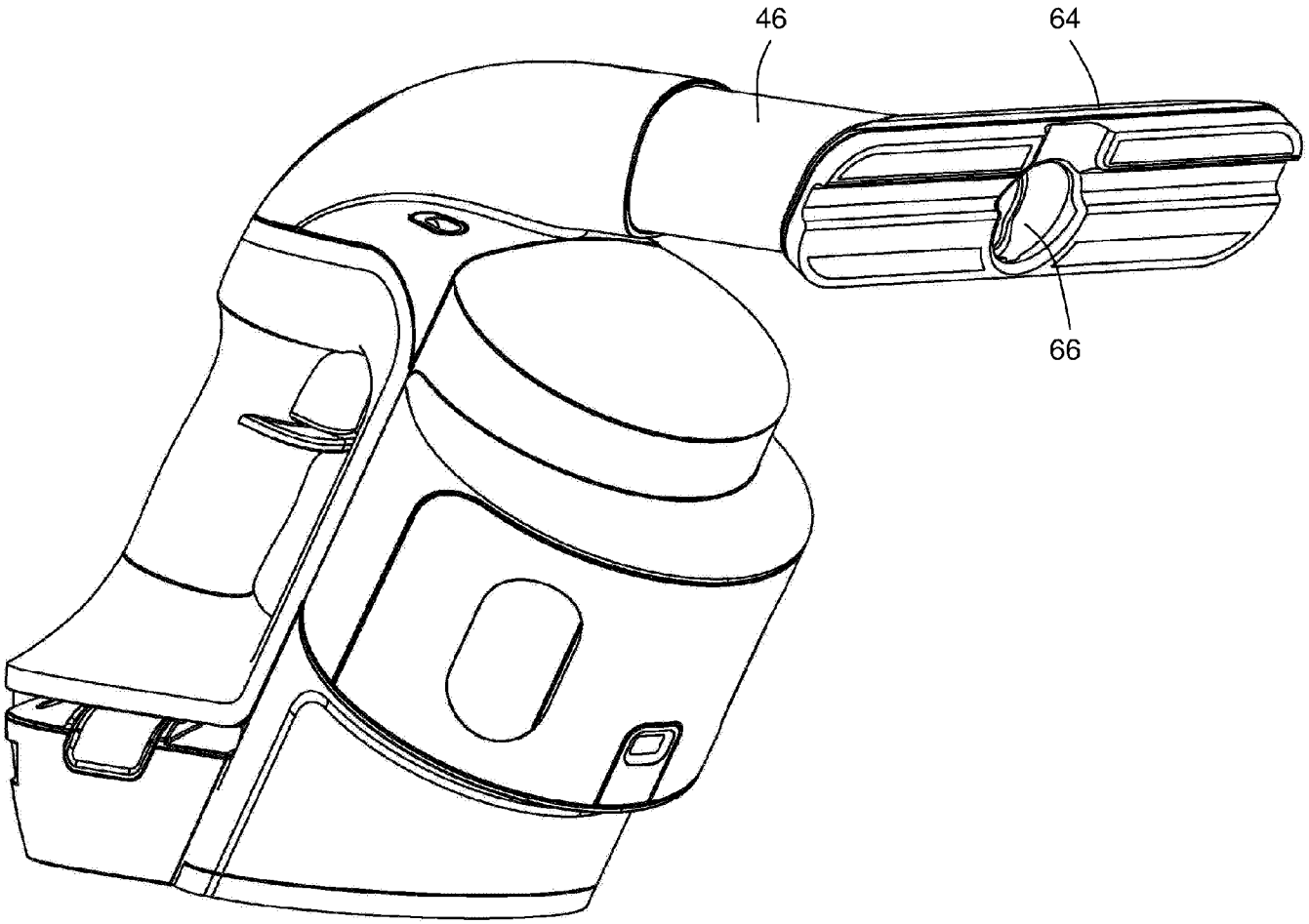
FIG. 6 shows a perspective view of the vacuum cleaner, with an upholstery tool fitted to the nozzle.
Figure 7:
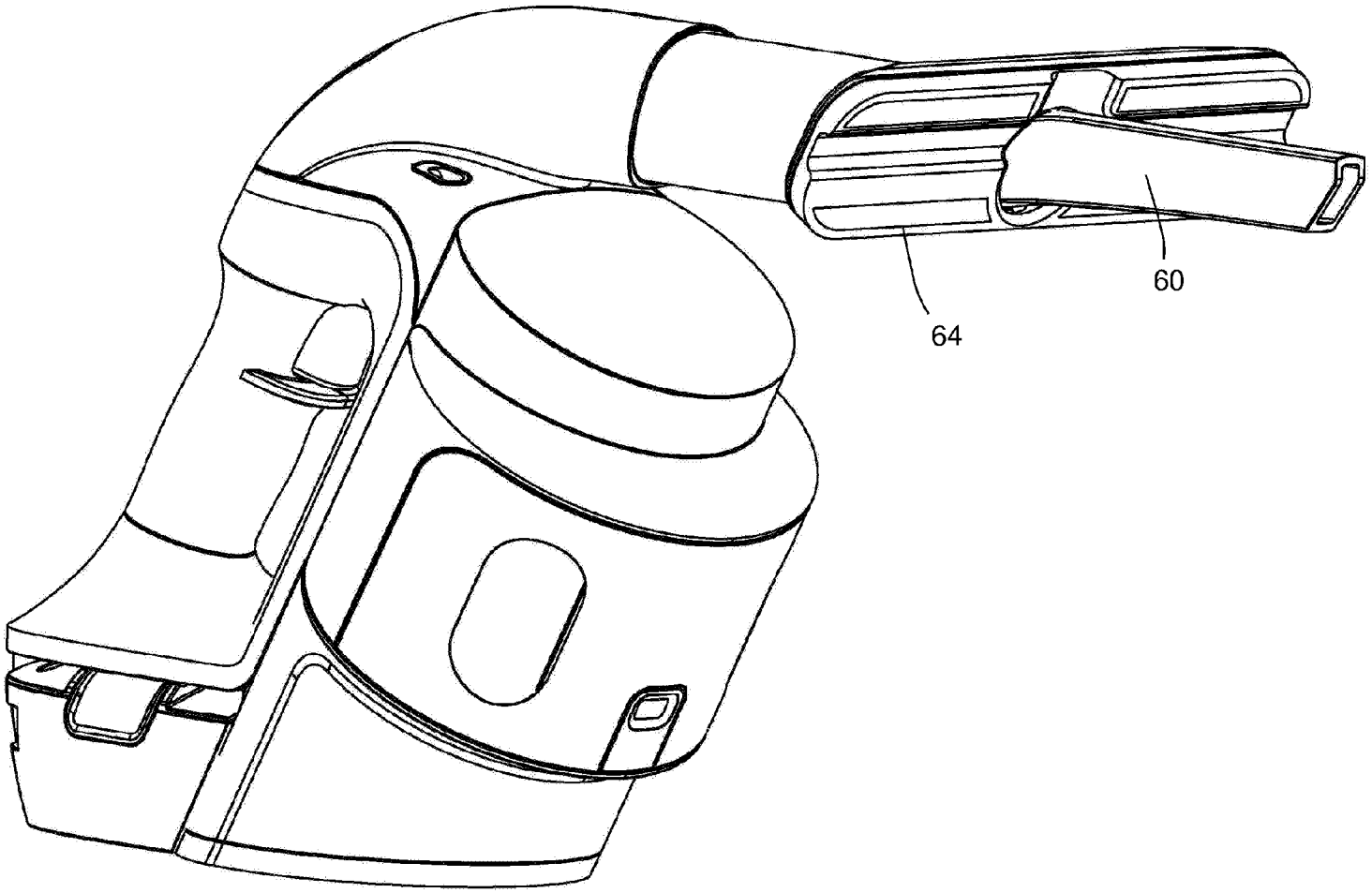
FIG. 7 shows a perspective view of the vacuum cleaner, with an upholstery tool and a crevice tool fitted to the nozzle.

FIG. 6 shows an upholstery tool 64 fitted to the nozzle 24. The centre of the upholstery tool 64 has a hole 66 which can accommodate the crevice tool as shown in FIG. 7. It is therefore not necessary to remove the upholstery tool 64 in order to fit and use the crevice tool 60. It is, however, necessary to remove the upholstery tool 64 (and also the crevice tool 60) in order to use the dusting brush 30. It is expected, however, that the periods during which the dusting brush 30 will be used are relatively few and short; the user may therefore typically use the vacuum cleaner 10 with the upholstery tool 64 fitted to the nozzle 24, and only remove the upholstery tool for the short and infrequent periods during which the dusting brush is required. The upholstery tool can therefore be used similarly to a suction head of an upright or cylinder vacuum cleaner.

There is no provision in the embodiment shown for storing the upholstery tool 64 upon the vacuum cleaner 10 when not in use. That is not required because that tool is mounted on the nozzle 24 for storage and most of the periods of use of the vacuum cleaner 10.

In the embodiment of FIG. 2 the extendable flexible hose 44 is of standard construction. FIGS. 8-12 show two alternative embodiments of extendable flexible hose according to the invention, and which are each suitable to replace the hose 44 in the vacuum cleaner 10.

Figure 8:
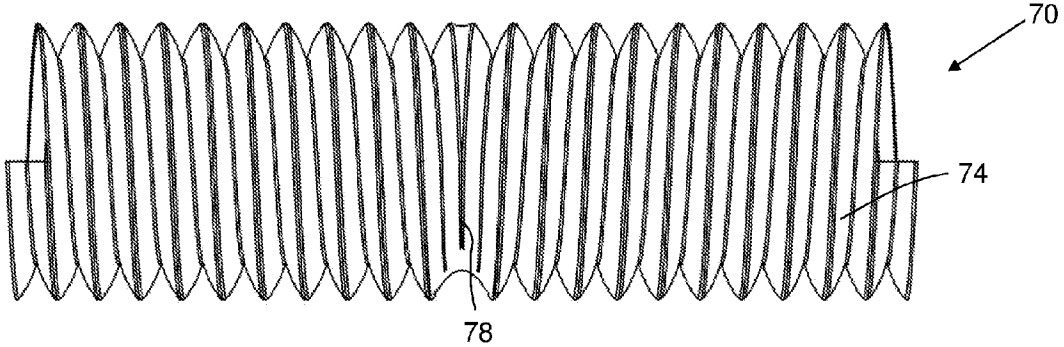
FIG. 8 shows a side view of a first embodiment of an extendable flexible hose.
Figure 9:
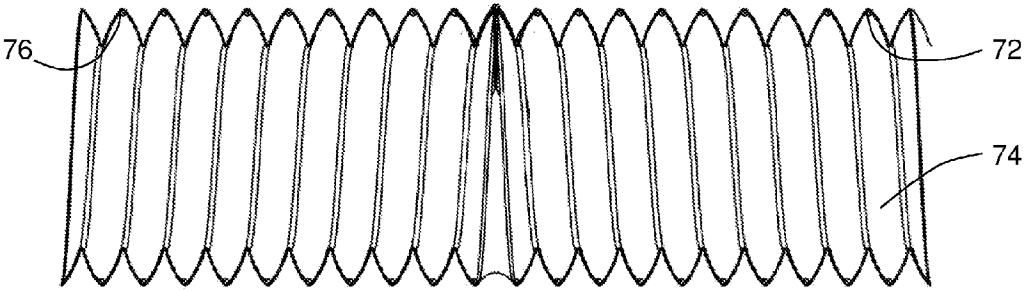
FIG. 9 shows a cross-sectional view of the hose of FIG. 8.
Figure 10:
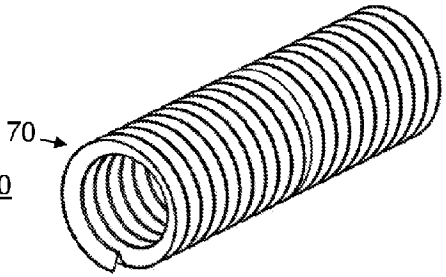
FIG. 10 shows a perspective view of the hose of FIG. 8.

The first embodiment of flexible hose 70 is shown in FIGS. 8-10. In conventional fashion, the hose is formed from a coil spring 72 between two layers of flexible plastic 74 which are initially separate, but which are bonded together, typically by partial melting of the plastic layers 74. The plastic layer 74 thereby binds to the coil spring 72, so that the coil spring and plastic 74 extend and contract together. Also in conventional fashion, in the present embodiments the coil spring is embedded within the plastic layer 74 and so is not visible in the side view of FIG. 8, and is only partially visible in the cross-sectional view of FIG. 9.

The hose 70 comprises a first spring 72 and a second spring 76, in this embodiment of identical length and identical material. The coil springs 72 and 76 differ only in the direction of winding. The end of the first coil spring 72, and the end of the second coil spring 76, are directly connected together (at 78), either by adhesive, welding, or a suitable clip or collar, as desired. Alternatively, the ends are held together by way of their respective bonding to the plastic 74.

Figure 11:
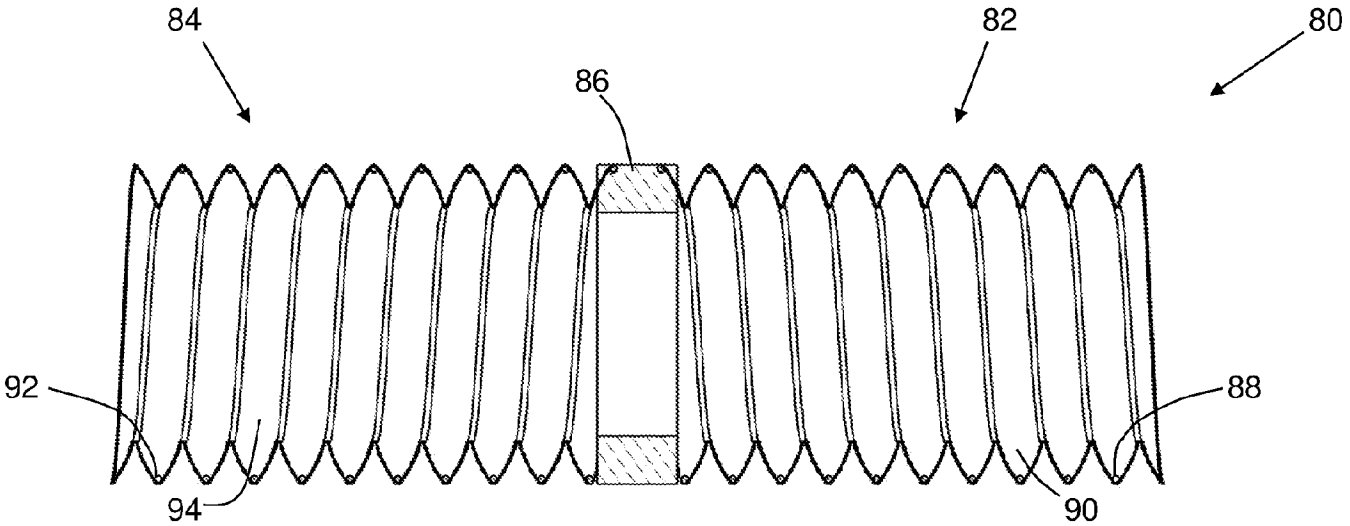
FIG. 11 shows a cross-sectional view of a second embodiment of extendable flexible hose.
Figure 12:
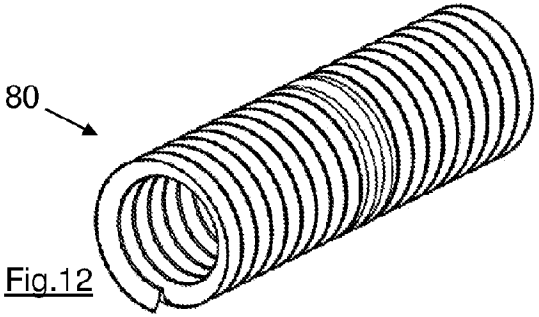
FIG. 12 shows a perspective view of the hose of FIG. 11.

The second embodiment of FIGS. 11 and 12 differs from the first embodiment only in the means of connection of the coil springs. Rather than the coil springs being directly connected and having a continuous layer of plastic along the whole of the hose, the hose 80 comprises two separate hose parts 82, 84 joined by a substantially rigid collar 86.

The hose part 82 comprises a coil spring 88 and one or two layers of plastic 90, whilst the hose part 84 comprises a separate coil spring 92 and a separate layer (or layers) of plastic 94. It will be understood that the ends of the coil springs 88, 92 are permanently secured to the collar 86, and the layers of plastic 90, 94 are secured to the collar in an airtight manner.

When the hose 44 of the vacuum cleaner 10 is released and extended, the coil spring of the hose seeks to unwind. Unless the unwinding is resisted (which may not be possible, and in any event can result in a part of the hose collapsing, as above stated) the nozzle 24 will twist as the hose 44 is extended. If, on the other hand, the hose 70 or the hose 80 is used instead of the hose 44, then there is no tendency of the nozzle to twist, regardless of the extension of the hose.

It will be understood that the hose 70, or the hose 80, can be used with any upright vacuum cleaner using an extendable flexible hose. It will be also understood that the hose 70, 80 can be used in other applications having extendable flexible hoses which are constructed similarly to the method described. Similar extendable flexible hoses are often used at the outlet of tumble dryers, for example, and those hoses could share the benefits of a hose as described herein. Also, many air ducts incorporate one or more extendable flexible hoses; the provision of a hose as described herein could likely reduce the wear which is often experienced by the hoses in such air ducts, even those incorporating rotating joints.

Figure 13:
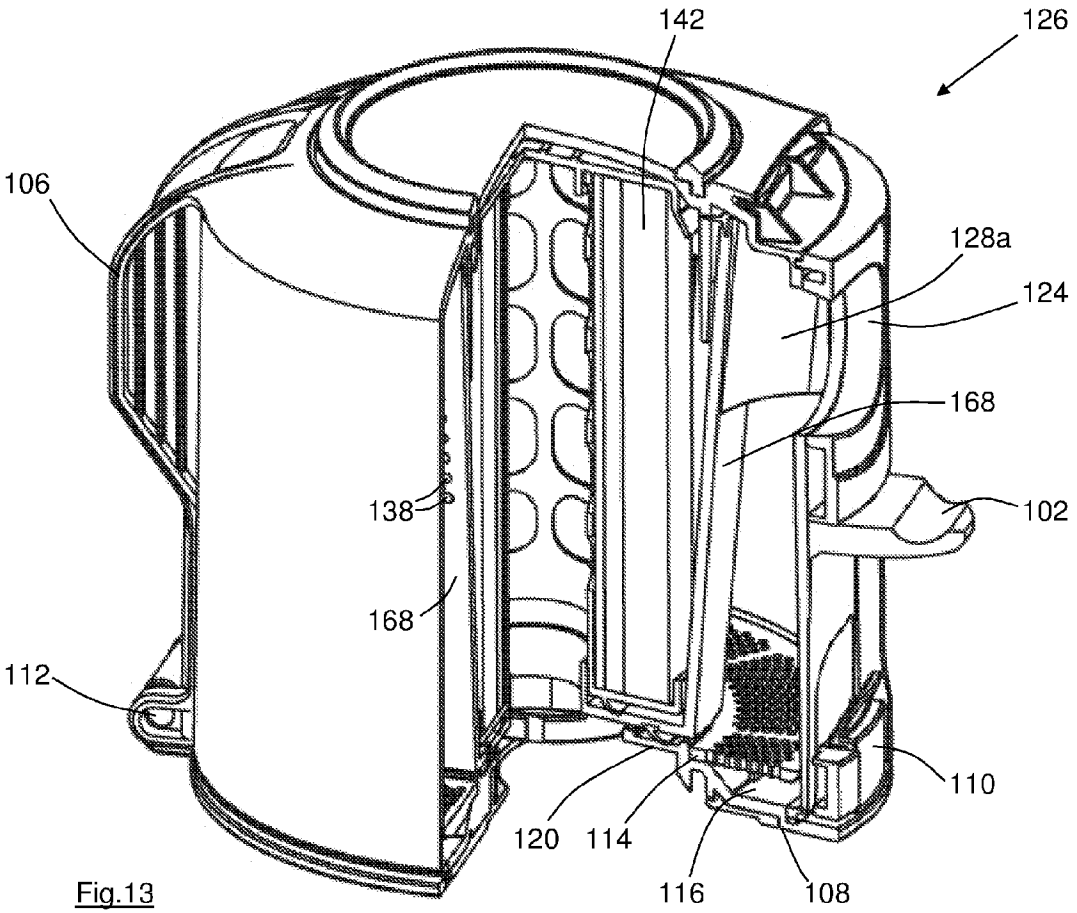
FIG. 13 shows a cut-away perspective view of a modified collector of the vacuum cleaner according to the invention.

FIG. 13 shows a preferred design of collector 126 for the vacuum cleaner, as an alternative to the collector 26 shown in FIGS. 1-7. The collector 126 is also designed to be removably mounted to the body 12 of the vacuum cleaner (and is ideally a direct replacement for the collector 26 of FIGS. 1-7). The clip 102 (which will be directed towards the carrying handle 20 when the collector 126 is fitted to the vacuum cleaner body) is designed to cooperate with a detent mechanism of the body so as to temporarily secure the collector 126 to the body. The hand-grip 106 (which is directed away from the carrying handle 20 when the collector is fitted to the vacuum cleaner body) is designed to facilitate the removal of the collector 126 from the body for emptying.

In common with the collector 26 of the previous application, the base 108 of the collector 126 can be opened by releasing a clip 110 and pivoting the base 108 about a hinge 112.

It will be understood that the clip 110 is inaccessible when the collector 126 is mounted to the body 12 of the vacuum cleaner.

Within the collector 126, located close to the base 108, there is a perforated plate 114. The perforations in the plate 114 are large enough (typically around 2 mm) to allow fine dirt and dust to pass through, but since the air flow between the perforated plate 114 and the base 108 is minimal the likelihood of any fine dirt and dust becoming re-entrained into the air flow is very small.

The perforated plate 114 is spaced from the base 108 by a distance which is less than 1 cm, and ideally around 5 mm, and is carried by the base 108. When it is desired to empty the collector 126 it is removed from the body 12 of the vacuum cleaner and held over a waste bin or the like. The base 108 is opened to allow the captured dirt to be deposited into a waste bin. The captured dirt will comprise fluff, hair and dirt entrained therein which has not passed through the perforated plate 114, as well as dirt and dust which has passed through the perforated plate and become collected in the region 116 below the perforated plate 114.

The perforated plate 114 may be removable in order to allow it to be thoroughly cleaned when desired. Desirably the perforated plate is held by friction onto a central boss 120 of the base 108.

Whilst the perforated plate 114 is substantially planar, in an alternative embodiment it is made conical, i.e. it is angled upwardly towards its outer periphery. This increases the area of the perforated plate and therefore allows an increase in the number (and/or area) of the perforations. Tests have shown that angling the perforated plate upwardly increases the amount of dust which is captured beneath the perforated plate and removed from the airflow.

Figure 14:
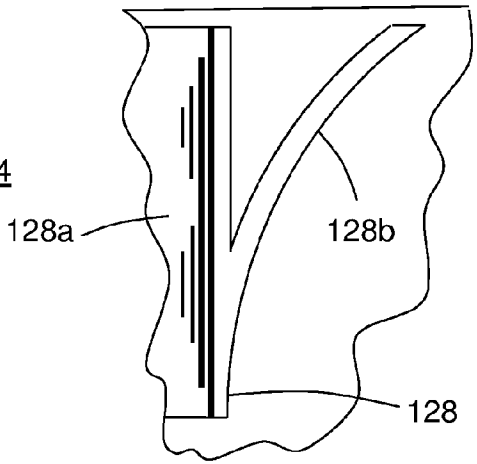
FIG. 14 shows a view of the baffle of the collector of FIG. 13.

FIG. 13 shows a part of the inlet 124 for the collector 126. Adjacent to the inlet 124 (and mounted upon the outside of the tube 168) is a baffle 128 (see also FIG. 14). The baffle 128 has a first curved surface 128*a* and a second curved surface 128*b* (the second curved surface 128*b* is not visible in FIG. 13, but is shown in FIG. 14). The surface 128*a* is curved generally around an axis which is approximately vertical, and the surface 128*b* is curved generally around an axis which is approximately horizontal. The air flow entering the collector 126 includes a tangential (or circumferential) component by virtue of the baffle surface 128*a* (and perhaps also by virtue of the form of the inlet 124 and the air flow conduit within the body 12). The air flow entering the collector 126 is therefore directed in an anticlockwise direction around the collector 126 when viewed from underneath. The air initially completes slightly less than one rotation of the collector before engaging the baffle surface 128*b* which redirects the air flow towards the base 108 (the circulating air approaches the baffle surface 128*b* from the right as viewed in FIG. 14). The air is therefore directed towards any hair and fluff which has already been collected at the bottom of the collector, and rapidly deposits its entrained dirt and dust. As the collector 126 fills the debris pile usually forms adjacent to the clip 110 and builds up in a clockwise direction when viewed from underneath, growing towards the inlet 124 until, when the collector 126 is nearly full, the air flow will only complete a fraction of a rotation.

The air, having deposited all (or at least most of) its entrained dust and debris, passes through a perforated tube 168. In this embodiment a cylindrical filter 142 is located within a perforated tube 168, the filter 142 being an alternative to (or preferably additional to) the filter 42.

It will be seen that the perforations 138 are formed through only a part of the wall of the tube 168. In particular, the perforations lie in a region which occupies only a small proportion of the overall height of the tube 168, and only a proportion of the circumference of the tube 168. The perforated region preferably spans the bottom of the baffle 128, so that at least some of the perforations 138 lie above the level of the bottom of a baffle 128, and other perforations 138 lie below the bottom of the baffle.

The perforated region in this embodiment does not extend more than approximately half way down the tube 168 since in practice any perforations towards the bottom of the collector 126 will quickly become covered by the level of collected dirt.

Though not shown in the drawings, a visual indicator is provided to inform the user of the status of the filter 142, collector 126 and inlet tubes. Preferably the vacuum cleaner includes a means to detect the current flowing through the motor, it being recognised that the current will be related to the volume of air flowing through the collector and the filter 142. A light is preferably located at the top of the carrying handle, which illuminates when the current reduces to a predetermined level, that level reflecting a soiled filter, a filled collector or a blockage of debris. The light can be accompanied by a symbol which is reproduced on the top of the collector so as to make it clear to the user that the light indicates that the filter should be cleaned and the vacuum checked for blockages. A further set of lights may be provided to indicate the charge currently in the batteries, the lights reducing in number as the charge reduces in the battery during usage and vice versa during charging.

Figure 15:
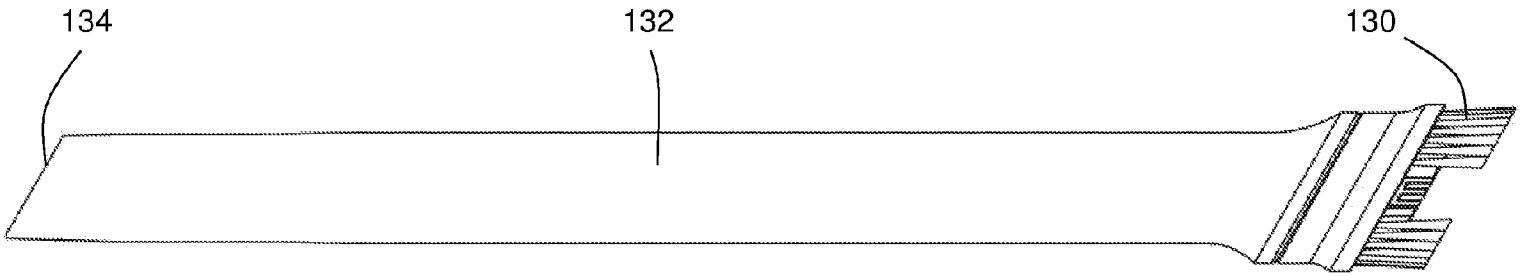
FIG. 15 shows a side view of an extension brush for use with the vacuum cleaner.

FIG. 15 shows an extension tube 132 which can optionally be provided for the vacuum cleaner 10. The end 134 of the extension tube 132 is designed to fit into the nozzle 24 of the vacuum cleaner, and in particular into the tube 36. The other end of the extension tube carries a dust brush 130. The extension tube 132 is designed to allow the hand-held vacuum cleaner to be used to clean skirting boards for example without the user having to bend down. The extension tube 132 may also be used with the flexible extendable hose (44, 70 or 80) deployed enabling the user to clean up high without having to hold the whole vacuum at an uncomfortable height. A secondary (and subsequent) extension tube (not shown) or either of the cleaning tools 60, 64 can be fitted to the nozzle within the dust brush 130 to further extend the reach of the vacuum cleaner, if desired.

In a particularly advantageous embodiment, the vacuum cleaner 10 has means to determine the blockage of the filter 42,142 and to alert the user that the filter requires cleaning. For example, a thermistor could be located within the air flow, perhaps within the central channel for example. A small current flowing through the thermistor raises the temperature of the thermistor, whereas the passing air flow cools the thermistor. A reduction in the air flow can therefore be determined by an increase in the temperature of the thermistor. Calculation or experiment can be used to determine the temperature rise which is indicative of a filter which is sufficiently blocked to require cleaning.

Ideally, the tube 48 is releasable from the body 12 to permit the removal of blockages. It will be understood that since the collector 26,126 can be removed, if the tube 48 is also removable access can be gained to all of the air flow passages which might become blocked during use.

As above indicated, the upholstery tool 64 can be used as a suction head if desired. In an alternative embodiment a larger suction head can be provided, and the suction head may if desired be powered, for example having a rotary brush bar. Thus, the vacuum cleaner can include electrical contacts upon the nozzle which can be engaged by corresponding contacts on the suction head. The use of electrical contacts avoids the requirement to run cables between the vacuum cleaner and the suction head.

It will be seen from FIGS. 3 and 6 that the tubular housing 46 is a continuation of the further tube 48 which itself is substantially a continuation of the carrying handle 20. The link between these components can be clarified by the colouring of the vacuum cleaner 10. The visual link which is created between these components makes them appear similar to the handle of a cylinder vacuum cleaner for example, and this is expected to reinforce the impression upon the user that the vacuum cleaner 10 is intended to supplement the use of a cylinder (or upright) vacuum cleaner.

The invention claimed is:

1. A hand-held vacuum cleaner having:

a body with a substantially planar base upon which the vacuum cleaner can rest when not in use, the body having a carrying handle, a motor and an impeller located within the body, the vacuum cleaner also having a collector and a battery, the battery located in a battery housing which provides at least a part of the base, the battery housing being removable, the motor and the impeller being outside the battery housing and located between the base and the collector, the vacuum cleaner having a nozzle which is spaced from the base, and, when the vacuum cleaner is located with its base upon a horizontal surface, the motor and battery are located below the horizontal plane which passes through the approximate centre of the carrying handle.

2. The hand-held vacuum cleaner according to claim 1 in which the carrying handle forms a closed loop with the remainder of the body of the vacuum cleaner.

3. The hand-held vacuum cleaner according to claim 1 in which the carrying handle has a longitudinal axis which is at an acute angle ($\alpha$) to the base.

4. The hand-held vacuum cleaner according to claim 3 in which the acute angle ($\alpha$) is between 50° and 70°.

5. The hand-held vacuum cleaner according to claim 3 in which the angle ($\alpha$) is approximately 60°.

6. The hand-held vacuum cleaner according to claim 1 in which a dust brush is mounted upon the nozzle.

7. The hand-held vacuum cleaner according to claim 1 in which at least part of the carrying handle is hollow and adapted to locate a crevice tool.

8. The hand-held vacuum cleaner according to claim 1 in which the nozzle is in communication with the collector by way of an extendable flexible hose, the nozzle being spaced from the base when the extendable flexible hose is not extended.

9. The hand-held vacuum cleaner according to claim 8 in which the extendable flexible hose, when not extended, is located within a substantially rigid tubular housing.

10. The hand-held vacuum cleaner according to claim 1 having a lighting unit adapted to illuminate the region adjacent to the nozzle.

11. The hand-held vacuum cleaner according to claim 10 having a single control switch to actuate the motor and the lighting unit.

12. The hand-held vacuum cleaner according to claim 11 in which the control switch is a two-position switch, a first position actuating the lighting unit and a second position actuating the motor.

13. The hand-held vacuum cleaner according to claim 1 having a baffle within the collector adapted to direct the air flow towards the bottom of the collector.

14. The hand-held vacuum cleaner according to claim 13 in which the baffle has a second surface adapted to direct the air flow towards the bottom of the collector, and also has a first surface adapted to direct the air flow to circulate around the collector.

15. The hand-held vacuum cleaner according to claim 1 in which the collector is located between the carrying handle and the nozzle, the vacuum cleaner having an inlet to the collector, the inlet being located at side of the collector facing the carrying handle.

16. The hand-held vacuum cleaner according to claim 15 in which air passes over the top of the collector as it flows from the nozzle to the inlet.

17. The hand-held vacuum cleaner according to claim 15 having a further tube between the nozzle and the collector, the vacuum cleaner being configured so that the further tube is substantially a continuation of the carrying handle.

18. The hand-held vacuum cleaner according to claim 17 in which the nozzle has a longitudinal axis which is substantially parallel with the base, and the carrying handle has a longitudinal axis which is at an acute angle ($\alpha$) to the base.

19. The hand-held vacuum cleaner according to claim 18 in which the angle ($\alpha$) is approximately 60°.

* * * * *